United States Patent [19]

May

[11] Patent Number: 4,559,985

[45] Date of Patent: Dec. 24, 1985

[54] BOOM SUSPENDED WOOD SPLITTER

[76] Inventor: Jim May, 12110 SE. Pine St., Portland, Oreg. 97216

[21] Appl. No.: 608,813

[22] Filed: May 10, 1984

[51] Int. Cl.[4] ..... B27L 7/00

[52] U.S. Cl. ..... 144/193 A; 144/366

[58] Field of Search ..... 144/193 R, 193 A, 3 K, 144/366; 414/744 R, 744 A, 74 S

[56] References Cited

U.S. PATENT DOCUMENTS 3,834,436 9/1974 Burkett ..... 144/193 A 4,351,378 9/1982 Smith ..... 144/193 A

*Primary Examiner*—W. D. Bray

*Attorney, Agent, or Firm*—Eugene M. Eckelman

[57] ABSTRACT

A horizontal boom is rotatably mounted on an upright support and serves as a track for a movable member supporting, by means of a flexible line, wood splitting mechanism. The wood splitting mechanism includes a cylinder and piston rod assembly having splitting elements thereon which are moved apart and together by operation of the piston rod for accomplishing the splitting function. The wood splitting mechanism is movable vertically by a winch drum thereon for splitting wood on the ground in the entire area of reach of the boom around the upright support. The cylinder and piston rod assembly have an interengagement which prevents rotation of the piston rod in the cylinder.

5 Claims, 10 Drawing Figures

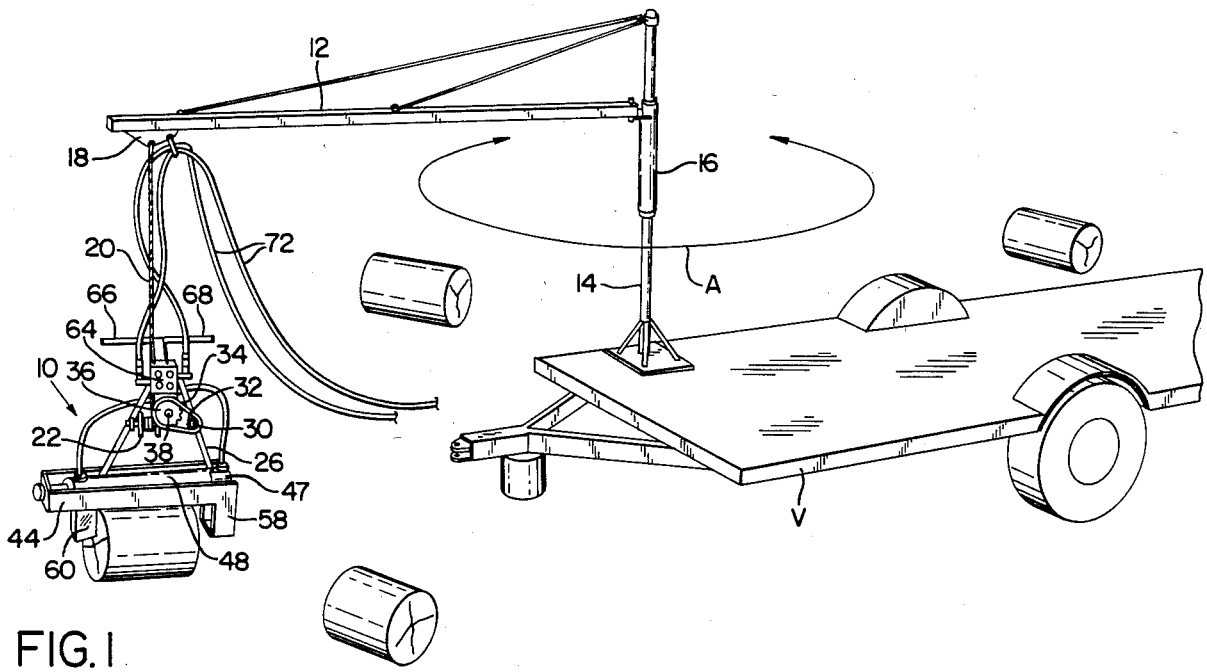
FIG. 1
FIG. 3
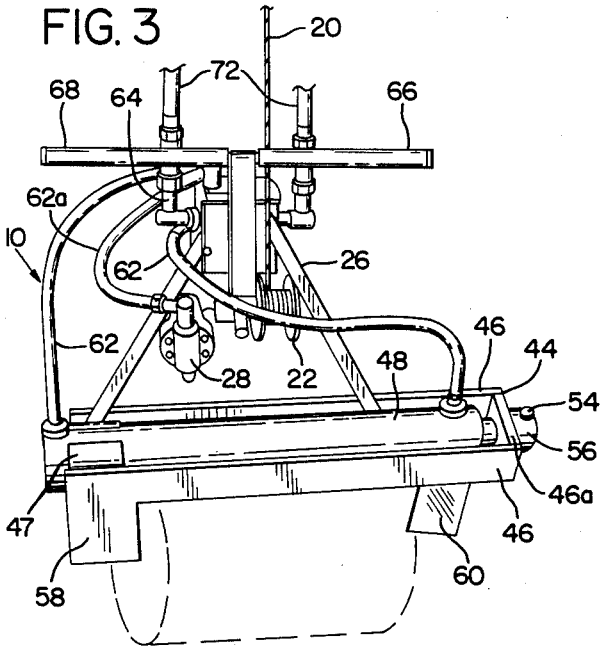
FIG. 2
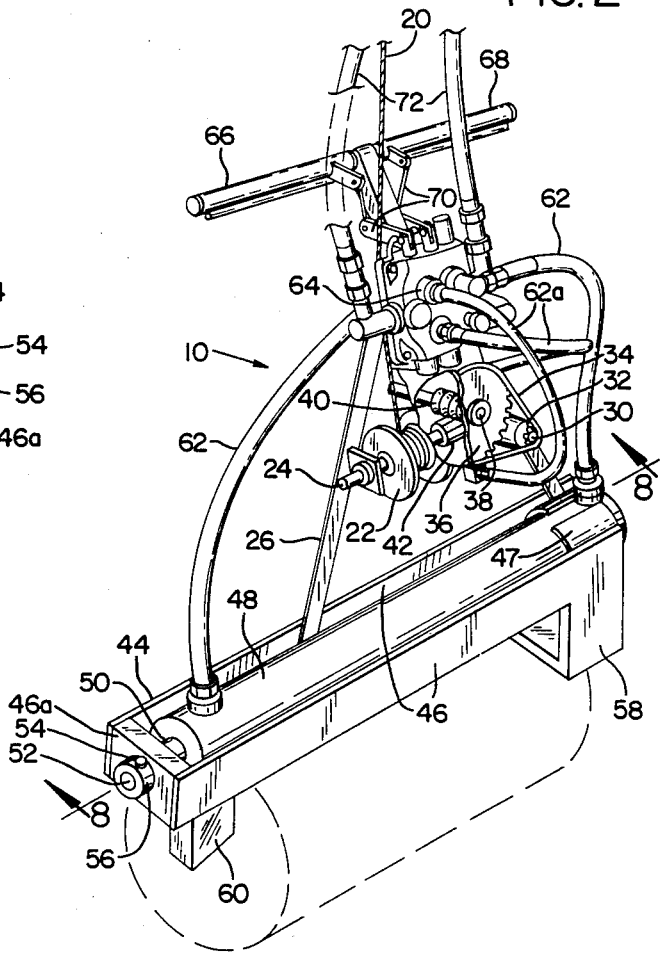

BOOM SUSPENDED WOOD SPLITTER

BACKGROUND OF THE INVENTION

This invention relates to new and useful improvements in wood splitters.

Various types of power operated wood splitters have been used and generally comprise trailer mounted splitting elements which require the wood to be loaded thereon for splitting. In addition, prior devices operate in a small area and this requires either constant shifting of the splitting mechanism or shifting of the wood that has been split.

SUMMARY OF THE INVENTION

According to the present invention and forming a primary objective thereof, a wood splitter mechanism is suspended from a rotatable boom whereby the splitter mechanism is capable of working in a 360 degree area around the boom support, and furthermore the splitting mechanism is constructed such that it can split wood lying on the ground.

Further objects of the invention are to provide a wood splitter having a novel boom suspension which allows use of the splitter in a large working area, to provide a novel cylinder and piston splitting head arrangement for splitting the wood in the suspended relation of the splitting mechanism, and to provide a novel lift arrangement for raising and lowering the mechanism on the boom.

Still another object is to provide a piston and cylinder arrangement having a novel cooperation such that the piston rod will not rotate in the cylinder.

To accomplish the invention, a horizontal boom is mounted on an upright support and has rotatable adjustment in a horizontal plane around such support. The boom has a track for a movable member, and wood splitting mechanism is suspended from this movable member by a flexible line. In the splitting of wood, the boom is swung around the support to any desired position and the movable member is moved along the boom to the splitting position desired. The splitting mechanism includes a winch drum to which the flexible line is connected. Power drive means connected to the winch drum are provided for raising and lowering the splitting mechanism. The splitting head includes a piston and cylinder assembly provided with splitting elements. The piston and cylinder assembly includes interengaging means which provide non-rotative association of the piston rod in the cylinder.

BRIEF DESCRIPTION OF THE DRAWINGS

FIG. 1 is a perspective view of the boom suspended wood splitter of the invention;

FIG. 2 is an enlarged perspective view taken similar to FIG. 1 but showing only the splitting mechanism;

FIG. 3 is also a perspective view of the splitting mechanism apart from the boom but taken from the opposite side from FIG. 2;

DETAILED DESCRIPTION OF A PREFERRED EMBODIMENT

Figure 4:
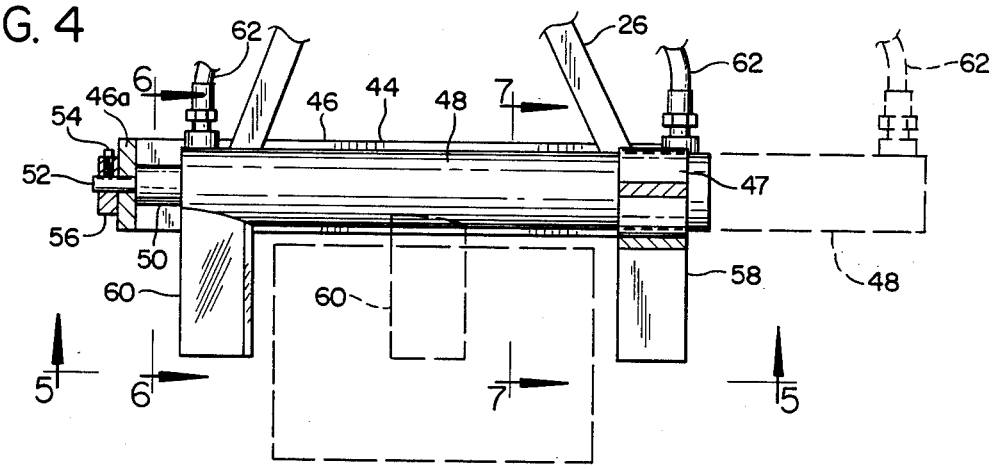
FIG. 4 is a fragmentary face view of a splitting head portion of the mechanism showing operative positions thereof in full and broken lines.
Figure 5:
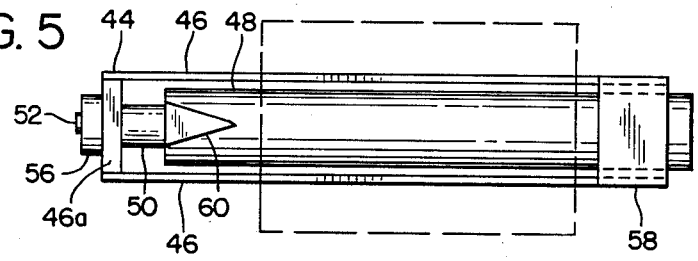
FIG. 5 is a bottom plan view of the splitting head portion.
Figure 6:
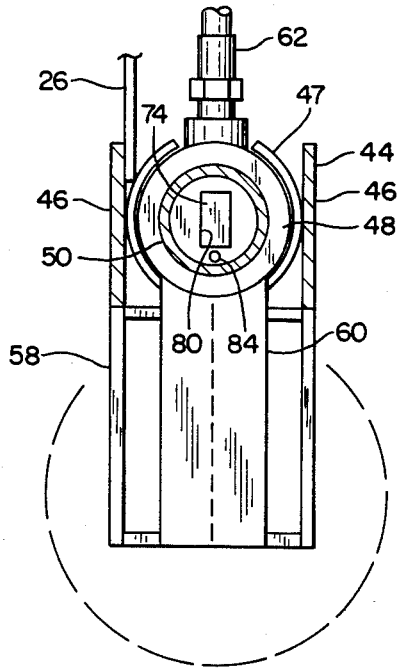
FIGS. 6 and 7 are enlarged sectional views taken on the lines 6—6 and 7—7, respectively, of FIG. 4.
Figure 7:
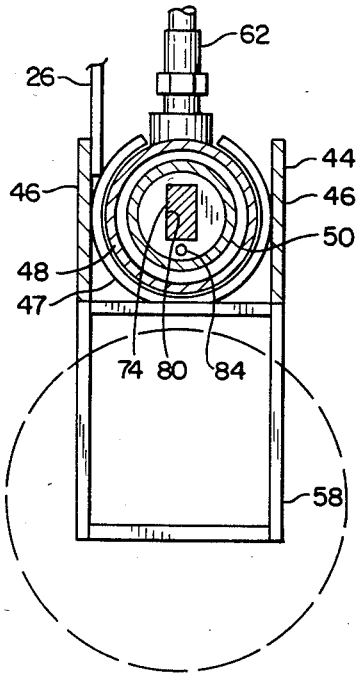

With particular reference to the drawings and first to FIGS. 1–3, the numeral 10 represents a wood engaging or splitting portion of the invention, to be described. This splitting portion is associated with a horizontal boom 12 supported on an upright post 14. The post 14 may be anchored to the ground, or preferably as shown, this post is secured on a vehicle V or the like which allows the splitting mechanism to be readily transported to different wood splitting sites. The boom 12 has free rotatable support 16 on the post 14 which allows the boom to rotate around the post in a complete circle if desired as designated by arrow A in FIG. 1.

The boom 12 comprises a track for an underside trolley 18 in a conventional manner to which is secured one end of a strong flexible line 20 such as a cable. The lower end of the cable 20 is coiled on a winch drum 22 keyed to a shaft 24 journaled on a rigid frame 26 of the wood splitting portion 10.

Secured to the frame 26 is an hydraulic motor 28 having an output shaft 30 to which a small sprocket wheel 32 is keyed. This sprocket wheel drives a chain 34 engaged with a larger sprocket wheel 36 on a shaft 38 having journaled support on the frame 26 and also having a worm gear 40 keyed thereto. This worm gear is in mesh with a gear 42 keyed to the winch drum shaft 24.

Integrally connected to the bottom end of the frame 26 is an open top and open bottom frame 44, also seen in FIGS. 4–7. This frame has side walls 46 and one end wall **46*a*, the other end of the frame being open but having a cradle portion 47 that slidably supports an hydraulic cylinder 48. A piston rod 50 in the cylinder has a reduced end portion 52, FIG. 8, on a piston head 50*a* in the cylinder and its projecting end secured, as by fasteners 54, in a boss 56 on the end wall 46*a* of the frame 44, the piston rod supporting the cylinder at this one end. The near wall 46 shown in FIG. 4 is broken away to show the cylinder 48 and other structure. One end of the frame 44 has an integral depending splitting element 58 thereon, comprising an abutment, and the cylinder at the opposite end from the abutment has an integral depending splitting element 60 comprising a wedge. Abutment 58 comprises an extension of frame 44 and wedge 60 comprises a depending weldment on the cylinder. It is to be understood, however, that these splitting elements may be reversed in position on the frame and cylinder. As the piston rod 50 extends from the cylinder, a relative movement is provided between the frame 44 and the cylinder 48 to draw the two splitting elements 58 and 60 together as shown in broken lines in FIG. 4. In such extension of the piston rod, the rod and the frame 44 remain stationary and the cylinder moves out the open end of frame 44**. Retracting movement of the piston rod causes the splitting elements to move apart.

Suitable conduits 62 are connected into opposite ends of the cylinder and lead to a control valve assembly 64 secured on the frame 24. Control valve assembly 64 also receives conduits **62*a* from the hydraulic motor 28**, and this valve assembly has hand controls 66 and 68 which operate linkages 70, FIG. 2, to the valve assembly for controlling operation of the hydraulic motor 28 and the cylinder 48. More particularly, one of the controls, such as control 66 is arranged to operate the hydraulic motor 28 to adjust the vertical position of the splitting portion relative to the overhead support comprising the boom 12 and the other lever 68 operates the cylinder. Conduits 72, FIG. 1, lead from the valve assembly to a power source such as a gasoline or electric motor and an associated hydraulic pump. Such power source is preferably supported adjacent the support post 16 and can be mounted on a transporting vehicle along with the other mechanism.

With particular reference to FIGS. 7, 8, 9 and 10, the cylinder and piston assembly has a structural relationship which prevents the piston rod from turning in the cylinder. For this purpose, the piston rod 50 is hollow and the cylinder has an elongated bar 74 secured integrally to one end of the cylinder, as by welding. This bar extends through a greater portion of the length of the cylinder and passes through the piston head 50*a* and into the hollow piston rod 50. This bar is slightly shorter than the cylinder. Such bar is rectangular in cross section, or other non-round configuration, and the piston head 50*a* has an aperture 80 of a shape corresponding to the cross sectional shape of the bar 74. Bar 74 has slidable guided engagement in the aperture 80 and since such bar is integral with the cylinder, the piston head and piston rod cannot turn in the cylinder.

Figure 8:
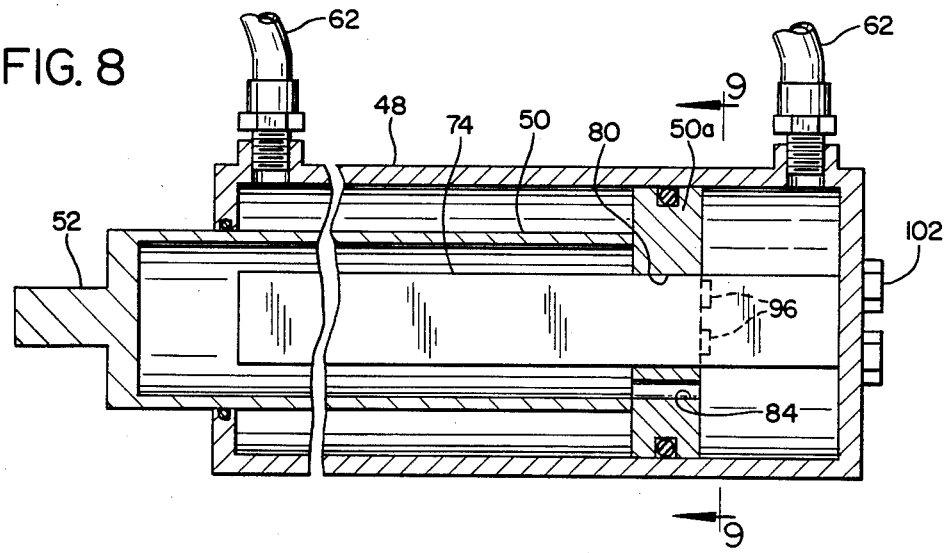
FIG. 8 is a foreshortened sectional view through the piston and cylinder assembly.
Figure 9:
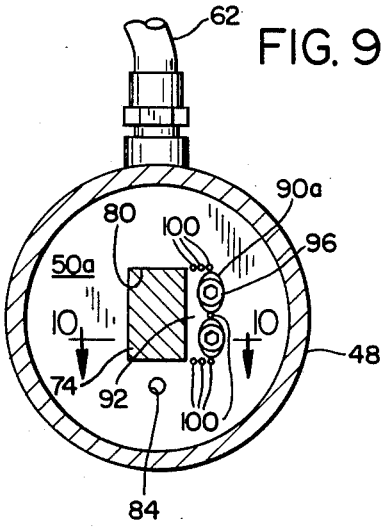
FIG. 9 is a fragmentary sectional view taken on the line 9—9 of FIG. 8.
Figure 10:
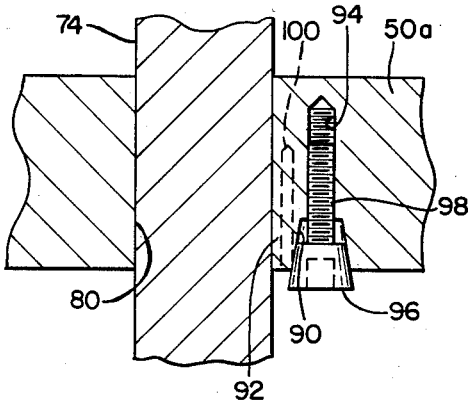
FIG. 10 is an enlarged fragmentary sectional view taken on the line 10—10 of FIG. 9.

Piston head 50*a* has one or more apertures 84 therethrough which establish communication between the cylinder and the hollow piston rod to allow fluid movement between the hollow piston rod and cylinder as the rod moves. Adjustable take-up means FIGS. 8, 9 and 10, are provided in the piston head 50*a* to maintain a close tolerance with the bar 74 and such comprises one or more bores 90 in one end of the piston head 50*a* which extend substantially parallel with the bar 74 and close thereto to provide a layer of material between the bar and bore 90. Bores 90 are tapered to a lesser diameter toward the bottom or inner end thereof and communicate with tapped bores 94. Bores 94 are arranged to receive the tapered head 96 of screws 98 threadedly engaged with the tapped bores 94. Tapered heads 96 are of an enlarged dimension relative to their tapered bores such that they have wedging engagement therein. Drilled holes 100 are provided in the face of the piston head in line with the bores 90 and also at the ends toward the bar 74. Ends of the bores 90, designated by the numeral 90*a* are cut away to form an oval-shaped bore whereby inward threaded movement of the screws distorts the material of the piston head toward the bar 74 due to the weakening of this area by drilled holes 100. Thus, by selected tightening of the screws 90, suitable tolerance can be maintained between the piston head and bar 74 and suitable adjustment made as wear occurs. End plugs 102 are provided in the adjacent end of the cylinder in alignment with screws 98 for screwdriver access to such screws.

In the operation of the present wood splitting mechanism into a splitting position, lever 66 is operated to raise or lower the mechanism over a log on the ground, the operator first swinging the mechanism in its suspended relation from the boom to the desired position. The other lever 68 is operated to retract the piston rod in the cylinder and thus spread the splitting elements 58 and 60 so as to place the latter at the ends of the log. The lever 68 is then reversed to expand the piston rod to split the log. By repeated raising and lowering of the mechanism and operation of its splitting elements, the operator can cover an entire area reachable by the boom 12 and in a complete circle of the latter around the support post 14. As is apparent, the wood does not have to be lifted for the purpose of splitting it but can remain directly on the ground or other convenient location during the splitting process. The non-rotative association of the piston rod in the cylinder always maintains the splitting elements 58 and 60 in a depending splitting position.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A wood splitting apparatus comprising
upright support means,
a horizontal boom mounted on said support means for spaced relation for the ground,
a movable member supported on said boom for adjustment along said boom,
a frame member,
a flexible line suspended from said movable member,
a winch drum journaled on said frame member connected to said flexible line for providing suspended support of said frame member on said line,
said winch drum being operative to raise and lower said frame member,
wood splitting means on said frame member whereby upon vertical adjustment of said frame member and upon positioning said wood splitting means along the boom over a log, said wood splitting means is capable of splitting logs within the area covered by said boom, and
handle means on said frame arranged to be grasped by the operator for manipulating the frame and wood splitting means over a log.

2. The wood splitting apparatus of claim 1 wherein said wood splitting means comprises an hydraulically driven assembly secured to said frame, and control means on said handle means for controlling operation of said hydraulically operated assembly.

3. The wood splitting apparatus of claim 1 wherein said wood splitting means and winch drum are operated by hydraulically driven means, said handle having oppositely extending portions, one of said handle portions having a control for the hydraulically driven means for said splitting means and the other of said handle portions having a control for the hydraulically driven means for said winch drum.

4. The wood splitting apparatus of claim 1 wherein the mounted arrangement of said boom on said support means allows said boom to swing horizontally whereby said wood splitting means is capable of working the area on the ground around the upright support means along the radius of said boom.

5. The wood splitting apparatus of claim 1 wherein said wood splitting means comprises an hydraulic cylinder and piston rod assembly, a first wood splitting member on one of said cylinders and piston rod assembly and a second wood splitting member on the other of said cylinder and piston rod assembly, said first and second wood splitting members extending downwardly from said cylinder and piston rod assembly for working on wood to be split by said suspended wood splitting means, and interengaging means between said cylinder and piston rod providing non-rotative engagement of said piston rod in said cylinder.

* * * * *